US010837740B2

(12) United States Patent
Cohen

(10) Patent No.: US 10,837,740 B2
(45) Date of Patent: Nov. 17, 2020

(54) REACTIVE ARMOR

(71) Applicant: David Cohen, Herzliya (IL)

(72) Inventor: David Cohen, Herzliya (IL)

( * ) Notice: Subject to any disclaimer, the term of this patent is extended or adjusted under 35 U.S.C. 154(b) by 59 days.

(21) Appl. No.: 15/552,994

(22) PCT Filed: Feb. 24, 2016

(86) PCT No.: PCT/IL2016/050207

§ 371 (c)(1),
(2) Date: Aug. 23, 2017

(87) PCT Pub. No.: WO2016/135724

PCT Pub. Date: Sep. 1, 2016

(65) Prior Publication Data

US 2018/0017358 A1 Jan. 18, 2018

(30) Foreign Application Priority Data

Feb. 26, 2015 (IL) ..... 237492
Mar. 26, 2015 (IL) ..... 237991
Jun. 18, 2015 (IL) ..... 239523

(51) Int. Cl.
*F41H 5/007* (2006.01)
*F41H 5/04* (2006.01)

(52) U.S. Cl.
CPC ..... *F41H 5/007* (2013.01); *F41H 5/0492* (2013.01)

(58) Field of Classification Search
CPC ..... F41H 5/007; F41H 5/04
See application file for complete search history.

(56) References Cited

U.S. PATENT DOCUMENTS

| | | | | |
|---|---|---|---|---|
| 7,685,922 | B1 * | 3/2010 | Martin | F41H 5/0414 89/36.01 |
| 7,688,278 | B2 | 3/2010 | Frenkel | |
| 8,833,229 | B2 | 9/2014 | Baxter et al. | |
| 2004/0020353 | A1 | 2/2004 | Ravid et al. | |
| 2007/0017361 | A1 | 1/2007 | Zank et al. | |
| 2008/0190276 | A1 | 8/2008 | Barger et al. | |
| 2009/0078109 | A1 | 3/2009 | Baxter et al. | |
| 2012/0177941 | A1 | 7/2012 | Peterson et al. | |
| 2013/0087038 | A1 | 4/2013 | Diehl | |
| 2013/0248003 | A1 | 10/2013 | Dodworth | |

(Continued)

FOREIGN PATENT DOCUMENTS

| | | |
|---|---|---|
| CA | 2853960 | 11/2014 |
| CA | 2853960 | 12/2014 |

(Continued)

OTHER PUBLICATIONS

International Search Report dated May 31, 2016 From the International Searching Authority Re. Application No. PCT/IL2016/050207. (7 Pages).

(Continued)

*Primary Examiner* — J. Woodrow Eldred

(57) ABSTRACT

A reactive armour module and method for providing protection against a tandem warhead, the tandem warhead providing a primary explosion followed after a small preset delay by a main explosion, the method comprising detecting the primary explosion, and detonating a directed blast, towards the end of the small preset delay, that disrupts the secondary explosion.

34 Claims, 17 Drawing Sheets

(56) References Cited

U.S. PATENT DOCUMENTS

| | | | | |
|---|---|---|---|---|
| 2013/0284003 | A1 | 10/2013 | Dodworth | |
| 2014/0096673 | A1 | 4/2014 | Zank et al. | |
| 2014/0224110 | A1* | 8/2014 | Sagebiel | F41H 5/007 89/36.09 |

FOREIGN PATENT DOCUMENTS

| | | | |
|---|---|---|---|
| EP | 1 734 332 | A2 | 12/2006 |
| EP | 1734332 | | 12/2006 |
| GB | 2295003 | | 5/1996 |
| GB | 2511870 | | 9/2014 |
| GB | 2511870 | A | 9/2014 |
| JP | 10-253296 | | 9/1998 |
| JP | 10-253297 | | 9/1998 |
| JP | 2001-002000 | | 1/2001 |
| JP | 2011-252674 | | 12/2011 |
| WO | WO 2012/121818 | | 9/2012 |
| WO | WO 2012121818 | | 9/2012 |
| WO | WO 2014/181226 | | 11/2014 |
| WO | WO 2014/181226 | A2 | 11/2014 |
| WO | WO 2014181226 | | 11/2014 |
| WO | WO 2016/135724 | | 9/2016 |

OTHER PUBLICATIONS

Supplementary European Search Report and the European Search Opinion dated Jan. 4, 2019 From the European Patent Office Re. Application No. 16754858.5. (13 Pages).

Supplementary Partial European Search Report and the European Provisional Opinion dated Sep. 20, 2018 From the European Patent Office Re. Application No. 16754858.5. (14 Pages).

Patent Cooperation Treaty, International Search Report, International Patent Application No. PCT/IL2016/050207, dated May 31, 2016, 7 Pages.

Patent Cooperation Treaty, Written Opinion of the International Searching Authority, International Patent Application No. PCT/IL2016/050207, dated May 31, 2016, 10 Pages.

Extended European Search Report in related application 16754858.5, dated Apr. 1, 2019, 13 pages.

International Preliminary Report on Patentability dated Aug. 29, 2017 From the International Bureau of WIPO Re. Application No. PCT/IL2016/050207. (11 Pages).

Communication Pursuant to Article 94(3) EPC dated Dec. 2, 2019 From the European Patent Office Re. Application No. 16754858.5. (6 Pages).

Notice of Reasons for Refusal dated Mar. 3, 2020 From the Japan Patent Office Re. Application No. 2017-563396 and Its Translation Into English. (9 Pages).

* cited by examiner

REACTIVE ARMOR

RELATED APPLICATIONS

This application is a 35 U.S.C. 371 national stage filing of International Application No. PCT/IL2016/050207, filed on Feb. 24, 2016, which claims priority from Israel Patent Application No. 237492, filed on Feb. 26, 2015; Israel Patent Application No. 237991, filed on Mar. 26, 2015; and Israel Patent Application No. 239523, filed on Jun. 18, 2015, the contents of which are hereby incorporated by reference.

FIELD OF THE INVENTION

The invention relates in general to the field of protecting armored vehicles or structures from approaching Kinetic Energy Penetrators (KEP) or rocket propelled HEAT warheads. More specifically, the invention relates to the protection of armored vehicles or structures from approaching Tandem warheads.

BACKGROUND OF THE INVENTION

Essentially HEAT (High Energy Anti-Tank) munitions operates by piercing the exterior armor of armored vehicle's, killing and maiming the crew inside, disabling vital mechanical systems, or both.

In order to enable armored vehicle to sustain a shaped charge HEAT impact (hereinafter referred as HEAT), an external explosive element titled Explosive Reactive Armor (ERA), is attached to vehicle's armor.

The ERA consists of sheets or a slab of high explosive, sandwiched between two plates, typically metal, called the reactive or the dynamic elements.

In one example, and in order to neutralize an incoming rocket propelled HEAT, such as RPG-7, and upon impact, the high explosive of the reactive armor detonates, forcibly driving the metal plates of the reactive armor apart, against a shaped charge jet. The projected plates disrupt the metallic jet penetrator.

In one prior art example, the ERA notable efficiency is primarily attributed to two fundamental mechanisms. First, the moving plates change the effective velocity and angle of impact of the shaped charge jet, changing the angle of incidence and reducing the effective velocity of the jet. In a second aspect, since the plates are angled compared to the usual impact direction of the shaped charge warhead, and as the plates move outwards, the impact point on the plate changes over time, requiring the jet to cut through fresh plate material. This second effect significantly increases the effective plate thickness during the impact.

The ERA has proven itself as highly efficient in defeating the rocket propelled HEAT-shaped charge warhead, such as, the RPG 7, TOW, LOW, etc.

As soldiers rely heavily on the use of rocket propelled HEAT to defeat armored vehicles, a new warhead technology named Tandem-Charge has been developed to defeat the ERA. In essence, a Tandem-Charge weapon is an explosive device or projectile that comprises two or more stages of detonation. It is effective against a reactive armor which is designed to protect an armored vehicle (mostly tanks) against anti-tank munitions.

As noted, the Tandem Charge comprises two or more detonation stages. The first detonation stage of the tandem-charge weapon is typically a weak charge that either pierces the reactive armor of the target without detonating it, leaving a channel through the reactive armor so that the second warhead may pass unimpeded, or simply detonating the reactive armor causing the timing of the counter-explosion to fail. The second detonation stage of the tandem-charge attacks the same location of the first detonation point of impact, where the reactive armor has been compromised. Since the reactive armor is the only element that enables the armored vehicle's integral armor to sustain an impact of a HEAT jet, as the reactive armor was compromised by the first detonating stage, the main charge (second detonation) has an increased likelihood of penetrating the main armor of the vehicle.

It is therefore an object of the present embodiments to provide a reactive armor module that can defeat Tandem warheads.

It is another object of the present embodiments to improve and augment the susceptibility of existing reactive armor modules to sustain a Tandem warhead hit.

It is still another object of the present embodiments to provide said improved reactive armor in manner which is simple, of relatively light weight, and highly reliable.

SUMMARY OF THE INVENTION

The invention relates to a reactive armor module which comprises: (a) front and back plates; (b) a particles layer in between said plates; and (c) an explosive layer in front of said back plate;

Preferably, the reactive armor module further comprises an additional explosive layer in between of the particles layer and the front layer.

Preferably, the particles within the particle layer are spaced apart.

Preferably, the reactive armor module is shaped to form a directional particles cloud by directing the blast effect.

According to one aspect of the present invention there is provided a reactive armor module which comprises:

a front layer of armour;

a layer of particles;

an explosive layer adjacent said layer of particles; and a rear layer of armour, the explosive layer triggerable by an incoming explosion to explode into said adjacent layer to eject said particles to disrupt a second explosion from said warhead.

A reactive armor module may comprise a second explosive layer in between the particle layer and the front layer.

In an embodiment, the particles within the particle layer are spaced apart by spacers.

The particles may comprise rigid particles.

A second explosive layer may be placed in between the particle layer and the front layer.

In an embodiment, the particles ay the particle layer are spaced apart by spacers.

The particles may be shaped into of spherical particles, cylindrical particles or a combination of shapes.

A second explosive layer may be found in between the particle layer and the front layer.

The explosive layer may be shaped to direct said explosion, thereby to form a directional particle cloud. The armour layers of armour may comprise steel, ballistic aluminum, Titanium, Aluminium, a polymer or a combination of a polymer and a rigid material.

A reactive armor module may be provided on an armored vehicle adjacent to, in front of or behind another reactive module, may be spaced from other modules and may have spacers which comprise energy absorbing material. The module may comprise a rigid layer between said explosive layer and said particle layer.

High explosive charge may be mixed with the particles of said particle layer.

A reactive armour module may comprise a casing, wherein a cross-section structure of the casing is designed to channel the energy of the explosion to achieve a desired particle cloud vector and shape.

The explosive layer may be shaped in a curved manner, and the casing may be shaped or curved.

A rigid material may be located on a part of the explosive, thereby to create a time-gap explosion between outgoing particles. The rigid material may comprise geometric elements. The geometric elements may comprise a pyramid shaped element inserted in between particles of the particle layer, the pyramid having a tip, the tip being towards the explosive layer.

A reactive armour module may comprise an additional front plate in front of the front layer of armour.

The additional front plate may comprise a trigger which, upon impact of an incoming HEAT jet on said trigger activates the explosive layer by one member of the group consisting of electronic signaling and a sequential blast, said sequential blast being of explosive material which is attached to said additional layer.

The trigger may be configured to manage triggering of said explosive layer prior to the impact by the jet.

The explosive layer may be shaped to explode with multiple epicenters.

The triggering mechanism may use a proximity fuse or a proximity sensor.

The explosive layer may be shaped to direct said explosion using the Monroe effect, and/or may use a blast lens.

An embodiment of the reactive armour module may comprise four explosive layers separating three particle layers.

The module may comprise a triggering element and a delay element, the delay element for delaying said explosion to wait for said second explosion of said warhead.

The triggering element may be supplied with voltage by one member of the group consisting of:

(a) a battery;

(b) a capacitor;

(c) an induction type circuit;

(d) an electromechanical element, that causes a pendulum type element to move within an electromagnetic field, thereby to generate electricity, said electricity to be fed into a capacitor, battery etc.;

(e) a piezoelectric element;

(f) chemicals or metals.

In use a blast of said explosive layer may be directed into a body of rigid particles of said particle layer, said body being arranged in a predetermined structure and the blast causing the structure to collapse into itself applying a plurality of multidirectional kinetic impacts on an incoming jet, thereby to deform said incoming jet.

The predetermined structure of the explosive layer may comprise at least one extension along said first layer, and in particular two extensions along said first layer, said blast being triggered non-centrally between said two extensions.

The reactive armour module as above may be combined with a second reactive armour module, the second reactive armour module comprising a front layer of armour;

a back layer of armour;

an explosive layer in between said front layer and said back layer;

a triggering mechanism; and the explosive layer being triggerable by said triggering mechanism with a delay by an incoming explosion to explode into said front layer to eject said front layer to disrupt a second explosion from said warhead.

The explosive layer may be shaped to direct said explosion, thereby to form a directional particle cloud.

According to a second aspect of the present invention there is provided a reactive armor module which comprises:

a front layer of armour;

a back layer of armour;

an explosive layer in between said front layer and said back layer;

a triggering mechanism; and the explosive layer being triggerable by said triggering mechanism with a delay by an incoming explosion to explode into said front layer to eject said front layer to disrupt a second explosion from said warhead.

According to a third aspect of the present invention there is provided a method of providing protection against a tandem warhead, the tandem warhead providing a primary explosion followed after a small preset delay by a main explosion, the method comprising:

detecting said primary explosion;

using said detecting to detonate a directed blast that disrupts the secondary explosion.

An embodiment may comprise adding a detonation delay between said detecting and said detonating, said delay being in accordance with said preset delay.

An embodiment may comprise using said directed blast to blast a cloud of rigid particles towards said tandem warhead to carry out said disrupting.

An embodiment may comprise causing an implosion of a layer of rigid particles, and in particular, asymmetrically detonating to direct said blast.

DETAILED DESCRIPTION OF PREFERRED EMBODIMENTS

Figure 1:
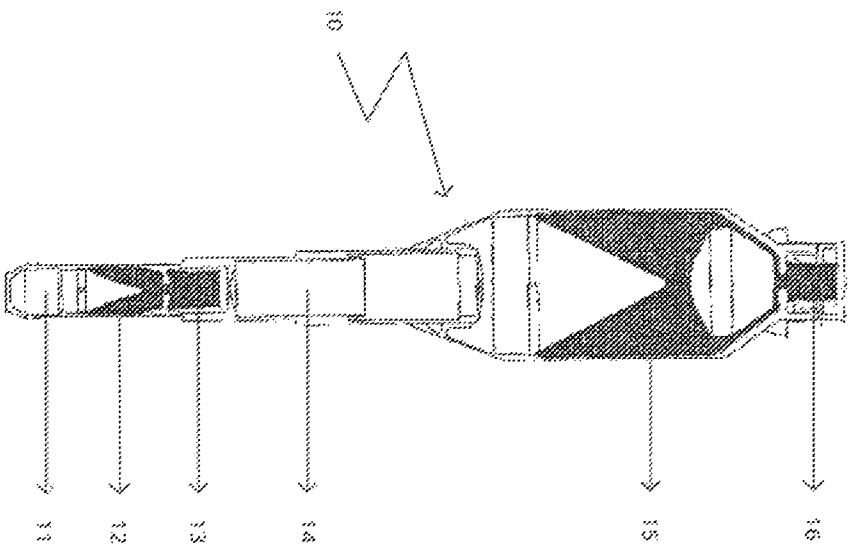
FIG. 1 illustrates the general structure of a HEAT-shaped charge Tandem warhead.

FIG. 1 illustrates the general structure of a HEAT-shaped charge Tandem warhead 10. Warhead 10 comprises a tip 11, initial (first) charge 12, a first-stage fuse 13, a spacing rod 14, a main charge 15, and a second-stage (main-charge) fuse.

As noted above, upon impact with a typical reactive armor, the first charge of the Tandem warhead detonates, initiating a first jet, which pierces or activates the reactive armor charge. Thereafter, at a highly precise timing, the second charge of the Tandem warhead detonates, initiating a second jet which penetrates the main body armor of the vehicle, through the space of the reactive module that was previously pierced by the first charge.

Figure 2:
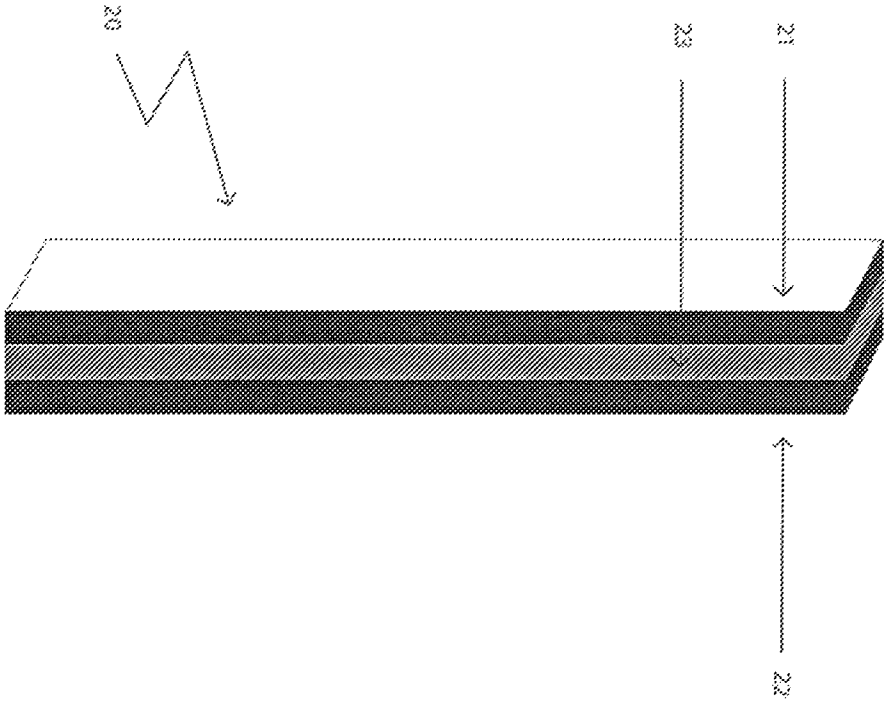
FIG. 2 illustrates in a cross-sectional form a typical reactive armor module.

A cross-section of a typical reactive armor module 20 is shown in FIG. 2. The reactive armor module comprises a front plate 21, a back plate 22, and a high explosive charge 23 in between said two plates. As said, the notable efficiency of the reactive armor is primarily attributed to two fundamental mechanisms. First, the moving plates change the effective velocity and angle of impact of the shaped charge jet, changing the angle of incidence and reducing the effective velocity of the jet. In a second aspect, since the plates are angled compared to the usual impact direction of the shaped charge warhead, and as the plates move outwards, the impact point on the plate changes over time, requiring the jet to cut through fresh plate material, in fact increasing the effective plate thickness during the impact.

While the typical reactive armor has proven itself as highly efficient in defeating the highly renowned rocket propelled HEAT-shaped charge warhead, such as, the RPG 7, TOW, LOW, etc., still it fails time and time again in defeating Tandem warheads, such as RPG-29.

Figure 3:
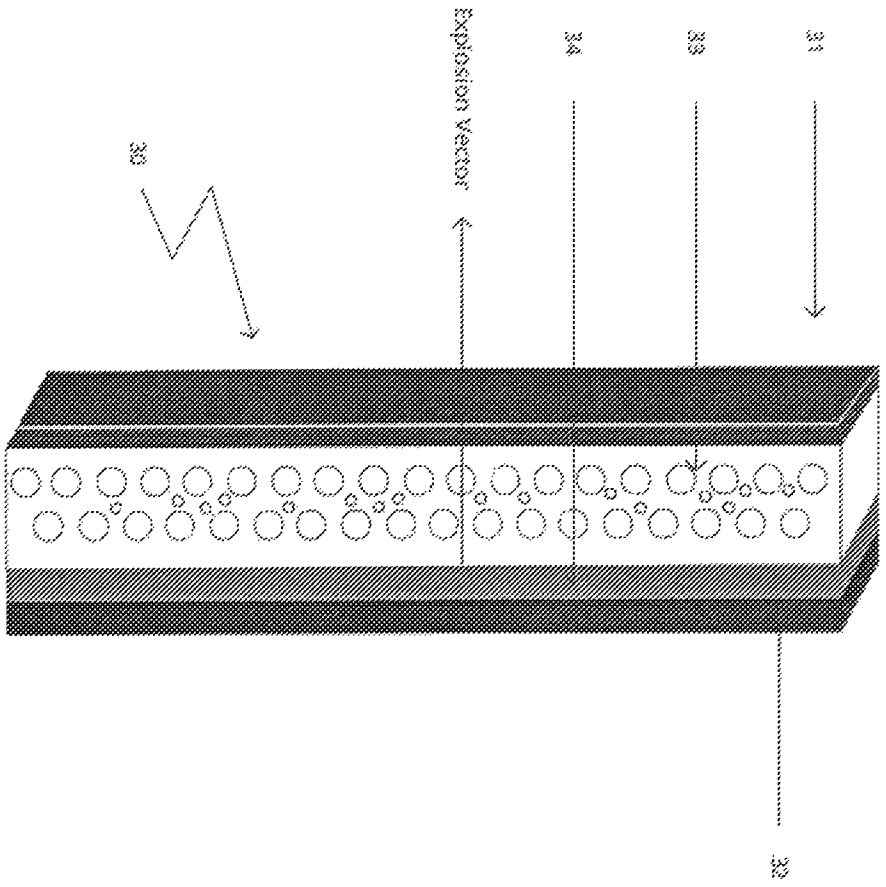
FIG. 3 illustrates in a cross-sectional form a structure of a reactive armor module, according to an embodiment of the invention.

FIG. 3 illustrates in a cross-section form a structure of a reactive armor module 30, according to an embodiment of the invention. Reactive armor 30 may be a stand-alone module, or may come as an add-on module to an existing reactive armor module. In the latter case, the armor 30 may come in front of the typical reactive armor module (20 in FIG. 2), or after module 20. In certain embodiments, a space may be provided between modules 30 and modules 20.

The module 30 of the present embodiments comprises a front plate 31, and a back plate 32. In one embodiment said plates are made of some rigid material such as steel, ballistic aluminum, Titanium, Alumina, etc., or some composition of said materials. In another embodiment, plates 31 and 32 are made of polymers or materials having similar characteristics, such Dynema, Spectra, Aramid, etc. In still another embodiment, the plates may be made of a combination of polymers and rigid materials. In still another embodiment, the front and back plates, 31 and 32 respectively, may be made of different materials or different material combinations.

Module 30 further comprises two internal layers in between said front and back plates 31 and 32. The first of said two layers is a particles layer 33, and the second of said two layers is a high-explosive layer 34.

The particles layer 33 comprises plurality of rigid particles. For example, the rigid particles may have a spherical shape, cylindrical shape, or shapes that are particularly designed to maximize the likelihood of ascertaining impact with the incoming Tandem warhead, and ascertaining penetration into the Tandem warhead. In some embodiments, a combination between various shapes may be used.

Figure 4:
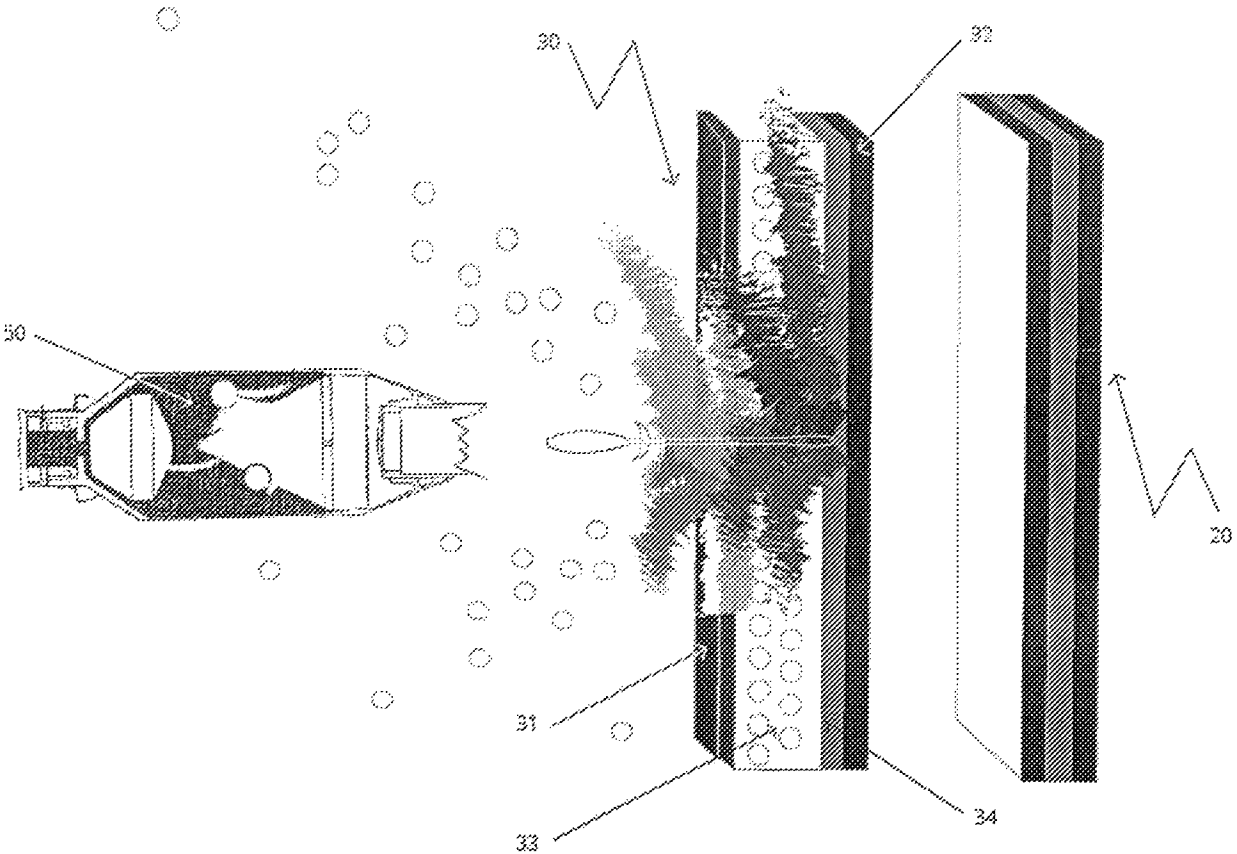
FIG. 4 describes the general manner of operation of the reactive module 30 of embodiments of the invention.

FIG. 4 describes the general manner of operation of the reactive module 30 of the present embodiments. Upon impact of a Tandem warhead 50 with the front plate 31, the first fuse of the Tandem warhead initiates a blast, resulting in a jet which pierces the front plate. As the jet goes through the particles layer 33, it eventually impacts the high explosive layer 34, resulting in a blast of said layer, that ejects the particles towards the main (second) charge of the Tandem warhead 50. These particles are ejected towards the incoming second portion of the Tandem warhead, impacting it at a very high speed before the blast of said second portion of the second warhead is initiated. Said impact of the metallic particles, that travel at a very high speed damages the integrity of the second portion of the Tandem warhead, severely impairing its ability to form a cohesive and focused jet. In some cases, the high number of particles may hit the second portion rendering it useless altogether, even without allowing its main charge to detonate.

In one embodiment, the particles are spaced apart to reduce the kinetic energy transfer between said particles that is caused by the mechanical impact that the jet causes. The separation between the particles may be achieved by coating each particle with a puffed energy absorbing material. Alternatively, energy absorbing elements may be provided between the particles. In still another alternative, the high explosive charge may be mixed between the particles. In still another embodiment, a back layer of high explosive charge is provided, in addition to mixing charge between the particles. In still another embodiment, an additional layer of explosive may be provided between the particles layer and the front plate. In still another embodiment, a rigid or composite material layer may be placed between the particles and the high explosive layer to prevent damage to the high explosive layer by the kinetic impact of the jet on the metallic particles that might damage the explosive charge.

In still another embodiment, the cross-section structure of the casing is designed to channel the energy of the blast to achieve a desired particles cloud vector and shape. For example, the high explosive is shaped in a curved manner, or is placed in a sloped or curved casing. In still another alternative, a rigid material might be placed on a part of the shaped explosive creating a time-gap explosion between outgoing particles. In another aspect, geometric elements such as a pyramid shaped element is inserted in between the particles with its tip towards the explosive layer to effect upon detonation the blast effect on the particles vector.

The reactive module 30 of the present embodiments may also comprise an additional front layer in front of the front plate 31. Such additional front layer may be used as a triggering mechanism that upon impact with the Tandem warhead will activate the reactive armor module either by an electronic signaling or by a sequential blast caused by explosive material which is attached to said additional plate.

In still another embodiment, a proximity fuse or sensor may be associated with one or more reactive armor modules 30, in to activate the detonation before the impact of the Tandem warhead with the front plate.

Figure 5:
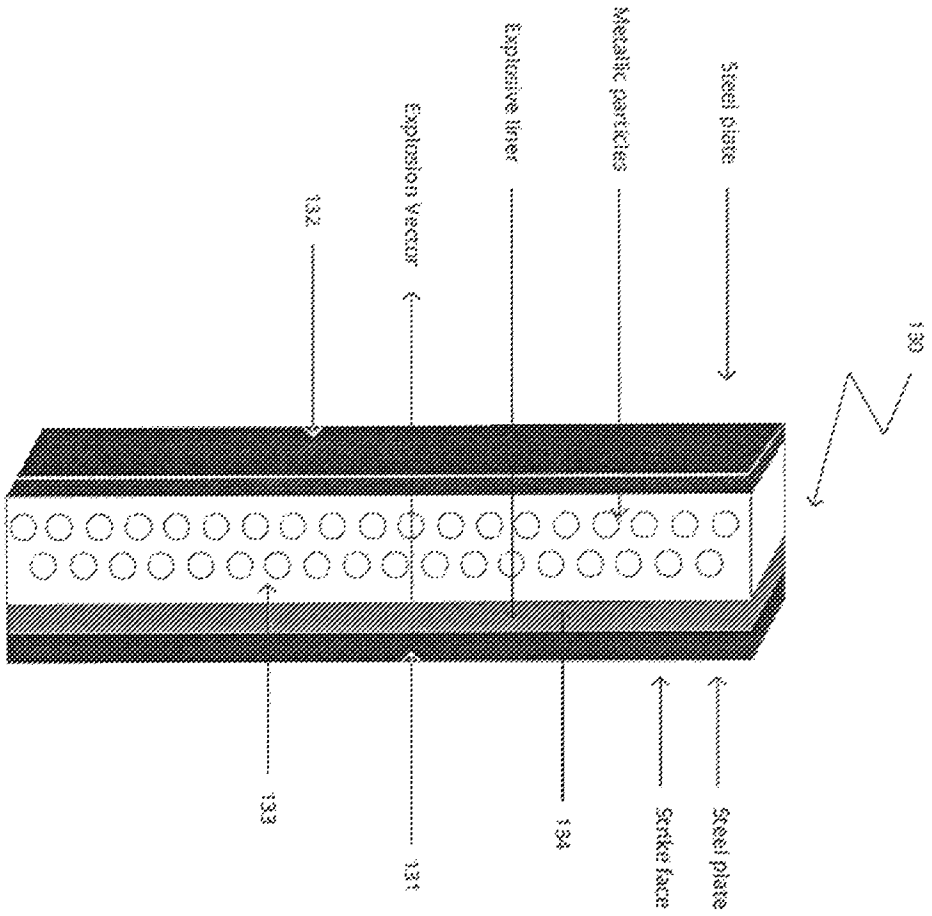
FIG. 5 shows a general structure of a reactive module according to still another embodiment.

FIG. 5 shows a general structure of a reactive module according to still another embodiment. In difference from the previous embodiments, the reactive module of FIG. 5 is designed to harness an effect know in the art as implosion wherein the blast of the reactive module is directed along the direction of the incoming HEAT jet wherein said blast wave is directed into a body of rigid particles that are arranged in a predetermined structure causing the structure to collapse into itself as the rigid particles that formed the structure change their relative position with respect to each other in a dynamic form applying a plurality of multidirectional kinetic impacts on said incoming jet, deforming it by subjecting it to a multitude of interactions with the moving particles, wherein the impact angle, velocity, surface face etc. of each particle affect the HEAT jet not only as it forms, but also in its initial penetration phase, as well as a continuous impacting on the HEAT jet tail, as the implosion residual blast energy causes the particles to continue their damaging motion, even after the initial impact. The reactive module 130 comprises a front plate 131, a back plate 132, a front explosive layer 134, which is attached to the rear surface of the front plate 131, and a particles layer 133. The explosive layer 134 of this embodiment covers substantially the entire area of the rear surface of the front plate 131. Upon impact of the HEAT charge, the explosive layer 134 is initiated as to create an explosion that causes the structure of the rigid particles to collapse into itself, imploding as discussed above, and effectively damaging said jet by causing said particles to exert high kinetic energy on said jet from multitude of directions, effectively destroying the jet.

Figure 6:
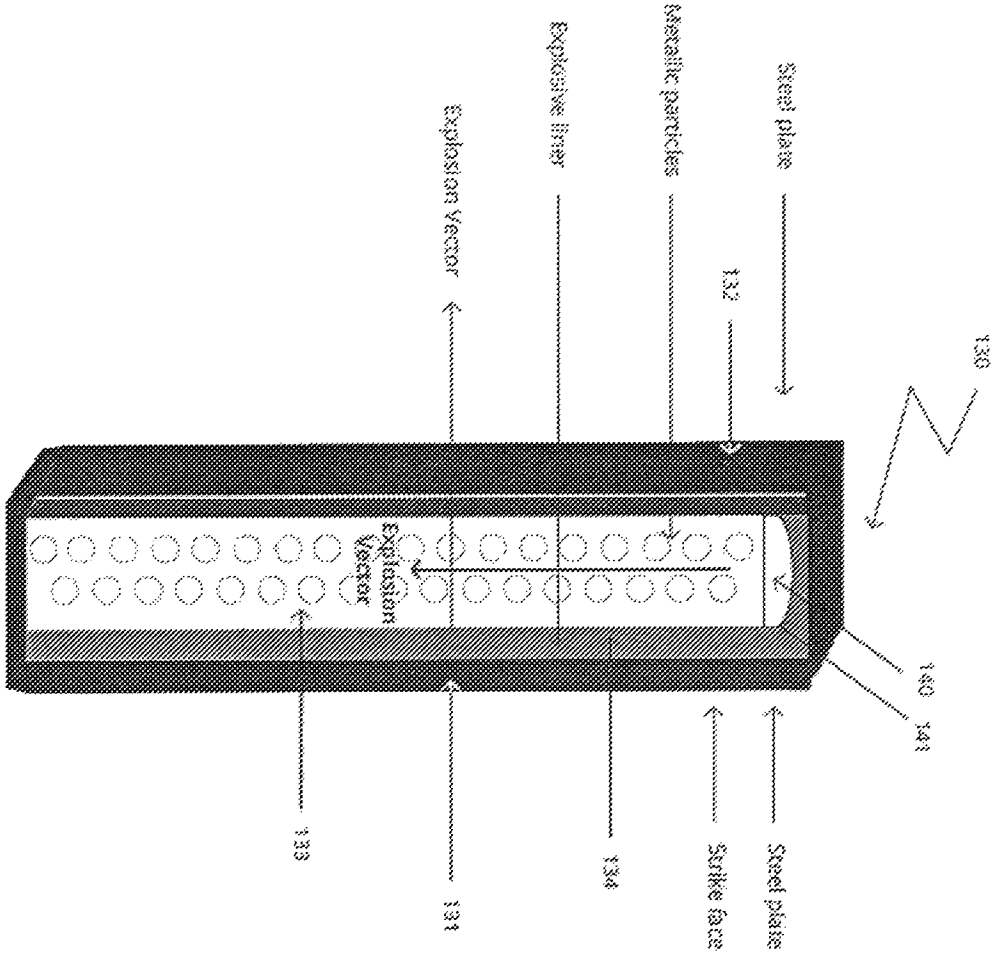
FIG. 6 shows still another embodiment of a reactive module 130, according to an embodiment of the present invention.

FIG. 6 shows still another embodiment of a reactive module 130, according to an embodiment of the present invention. The reactive module 130 comprises a front plate 131, a back plate 132, a front explosive layer 134, which is attached to the rear surface of the front plat 131, and a particles layer 133. The explosive layer 134 of this embodiment covers substantially the entire area of the rear surface of the front plate 131, and it also has an extension 141, along a side plate of the reactive module. Upon impact of the HEAT charge, the explosive layer is initiated as to create an explosion that causes the rigid particles to eject in accordance to the blast wave. As the geometry in this embodiment), the blast wave from each surface will cause the particles to move in plurality of directions exposing the incoming HEAT jet to a multitude of kinetic forces, effectively damaging said jet. Optionally, the explosive geometry varies as to create a multitude of shock wave epicenters, ejecting said particles causing them to exert high kinetic energy on said jet from multitude of directions, effectively destroying the jet. Furthermore, focusing of said shock wave generated by an explosion may be directed and/or amplified by means of shaping the explosive by creating a geometrical structure in said explosive as to achieve a directional blast wave in a manner known in the art as Monroe effect. Blast lens 140 is shaped to direct and amplify said shock wave in a given direction, as to catapult said particles in a collision course with said jet or with other particles as to generate a secondary impact on particles that in turn will affect the jet. This effect may be enhanced by inserting a liner to within said explosive lens 140. In an alternative embodiment said explosive lens functionality may be converted as to disperse said shock wave as to effect said rigid particles trajectory to a desired course.

Figure 7:
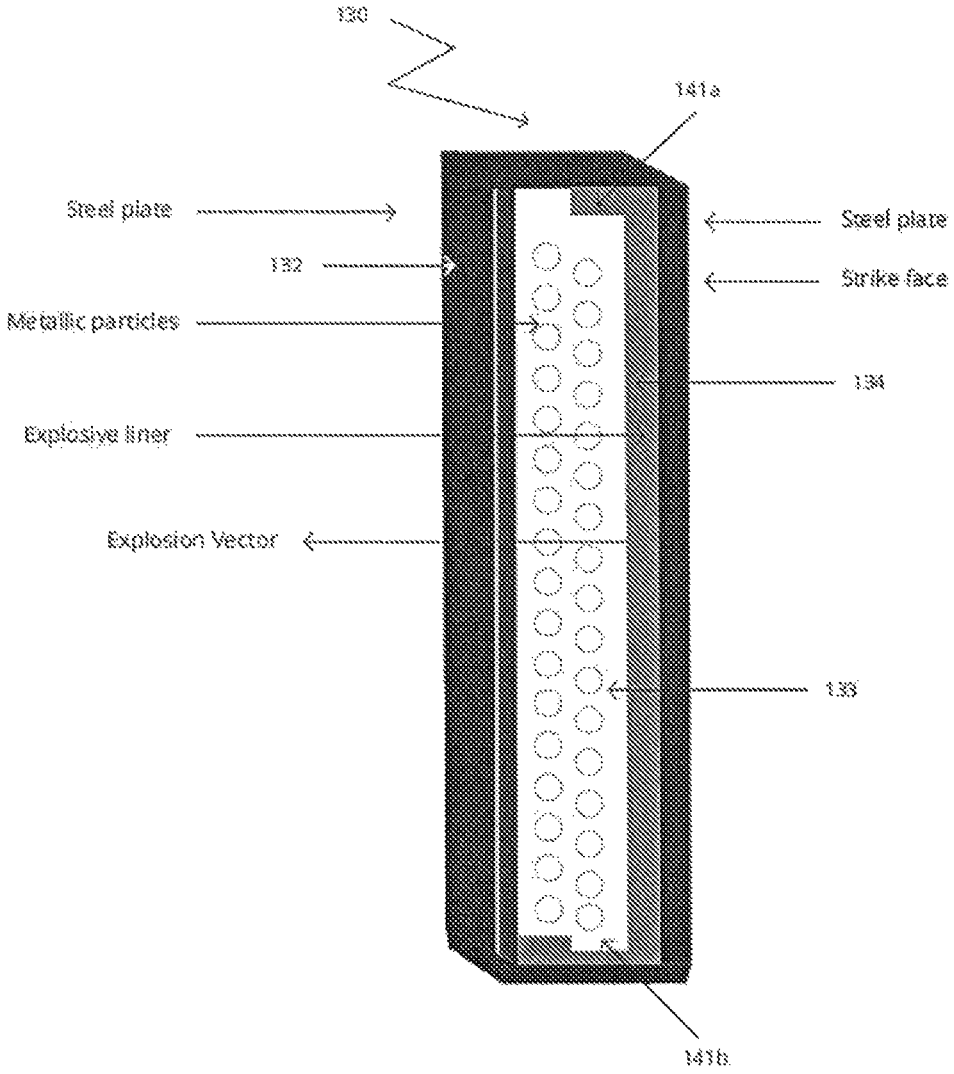
FIG. 7 shows still another reactive module according to an embodiment of the present invention.

FIG. 7 shows still another embodiment of the present invention. The reactive module 130 is similar in its structure to the embodiment of FIG. 6, while it still different from said embodiment as follows: While the explosive layer extension 141 of FIG. 6 covers one side surface entirely, the extension 141*a* covers only a portion thereof. Moreover, while in the embodiment of FIG. 6 there is only one extension 141, the embodiment of FIG. 7 comprises a second extension 141*b*, which is located in this example at the opposite corner of said reactive armor module 130. Preferably, the two extensions 141*a* and 141*b* are positioned on different axes, as shown. Upon impact of the HEAT charge, the explosive layer is initiated as to create an explosion that causes the rigid particles to eject in accordance to the blast wave. As the blast wave has more than one epicenter (as a result of the asymmetric explosive layer geometry in this embodiment), the blast wave from each surface will cause the particles to move in plurality of directions in a sequential manner, as upon impact, the incoming HEAT jet causes the explosive charge 134 to detonate. As the detonation point can either be close to extension 141*a* or extension 141*b*, the explosion will arrive one of said extensions earlier than the other. Different types of explosives might be used in extensions 141*a* and 141*b* to ensure such non-simultaneous explosions. Furthermore, the two extensions do not face exactly one another, as to prevent reduction of the blast yield effects. In another embodiment, rigid particles adjacent sides 141*a* and 141*b* respectively have one or more of: different mass, different shape, different structural alignment—e.g., wherein said particles are embedded in a materials of different densities and particle arrangement, material tensile strengths etc. A multitude of kinetic forces that are formed due to said asymmetric arrangement effectively damage said jet. Also in this embodiment, and in similarity to FIG. 6, the explosive geometry may vary as to create a multitude of shock wave epicenters, ejecting said particles causing them to exert high kinetic energy on said jet from multitude of directions, effectively destroying the jet. Furthermore, focusing of said shock wave generated by an explosion may be directed and/or amplified by means of shaping the explosive by creating a geometrical structure in said explosive as to achieve a directional blast wave in a manner known in the art as Monroe effect. Blast lens 140 (shown in FIG. 6) may be incorporated also in one or more location of the explosive layers as to shape, direct, and amplify said shock waves in given directions, as to catapult said particles in a collision course with said jet or with other particles as to generate a secondary impact on particles that in turn will affect the jet. This effect may be enhanced by inserting a liner to within said explosive lens 140. In an alternative embodiment said explosive lens functionality may be converted as to disperse said shock wave as to effect said rigid particles trajectory to a desired course.

Figure 8:
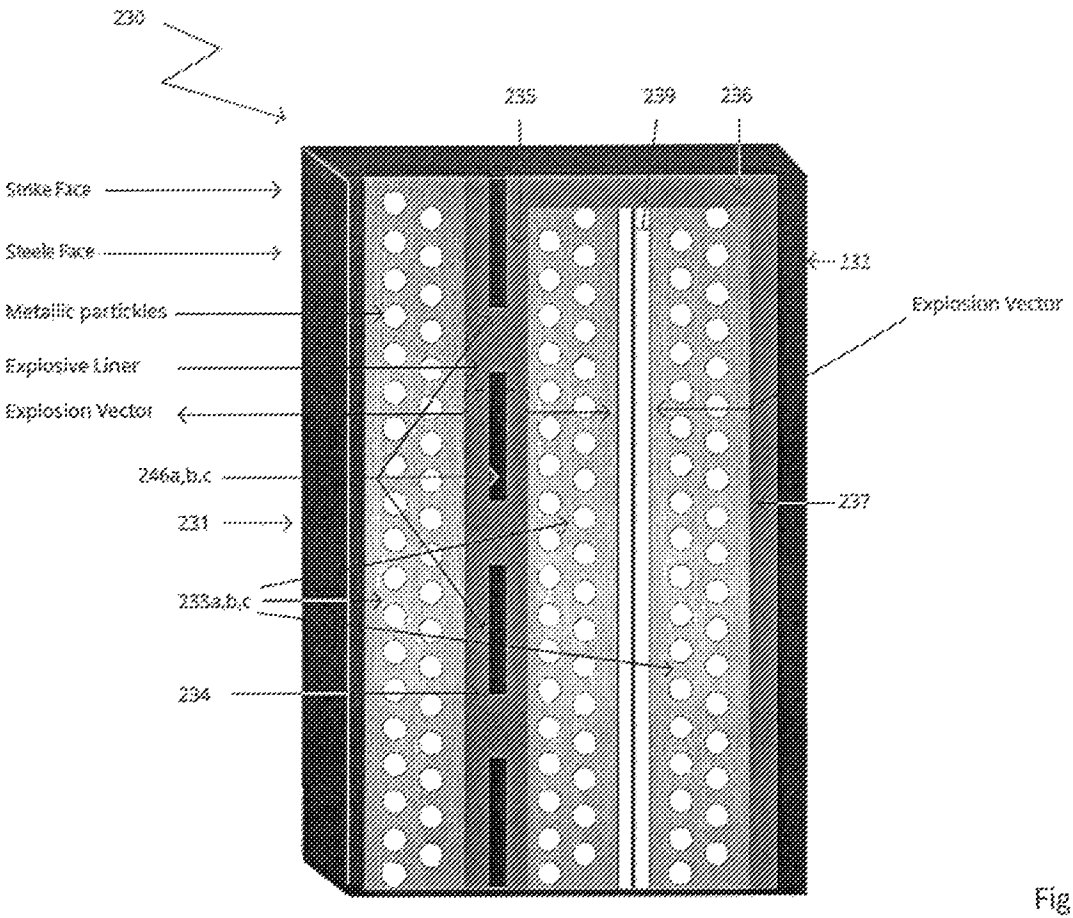
FIG. 8 shows still another reactive module according to an embodiment of the present invention.

FIG. 8 illustrates a three particles structures reactive module according to still another embodiment of the invention. The reactive module 230 comprises a strike and back faces 231 and 232, respectively, first explosive layer 234, second explosive layer 235 third explosive layer 236, and fourth explosive layer 237. A first steel wall with apertures 246*a*, 246*b*, and 246*c* separates between the first and second explosive layers 234 and 235, respectively. A separator 239 separates between a second particles structure 233*b* and third particles structure 233*c*. Upon impact with a HEAT jet, the explosive layer 234 explodes, ejecting rigid particles towards the incoming jet, and in case of a tandem warhead towards the main charge of the warhead. As the explosion initiates within the first particles structure 233*a*, the blast propagates via the apertures 246 activating the second explosive layer 235, causing an immediate explosion of the second explosive layer 235. As the second explosive layer 235 is detonated, an implosion process as described above in detail begins, within the particle structure 233*b*, that collapses into itself. Following this explosion, the blast propagates via the explosive layer 236, to begin a blast sequence of the explosive layer 237. The detonation of the explosive layer 237 causes the particles structure 233*c* to collapse into itself, as the whole particles mass collides with the collapsed particles structure 233*b*. This multiple explosion-structure implosion tandem process damages the incoming HEAT jet.

More specifically, multitude of kinetic forces that are formed due to said asymmetric arrangement effectively damage said jet. Also in this embodiment, and in similarity to FIG. 6, the explosive geometry may vary as to create a multitude of shock wave epicenters, ejecting said particles causing them to exert high kinetic energy on said jet from multitude of directions, effectively destroying the jet. Furthermore, focusing of said shock wave generated by an explosion may be directed and/or amplified by means of shaping the explosive by creating a geometrical structure in said explosive as to achieve a directional blast wave in a manner known in the art as Monroe effect. Blast lens 140 (shown in FIG. 6) may be incorporated also in one or more location of the explosive layers as to shape, direct, and amplify said shock waves in given directions, as to catapult said particles in a collision course with said jet or with other particles as to generate a secondary impact on particles that in turn will affect the jet. This effect may be enhanced by inserting a liner to within said explosive lens 140. In an alternative embodiment said explosive lens functionality may be converted as to disperse said shock wave as to effect said rigid particles trajectory to a desired course. It should also be noted that the inclusion of apertures within the steel plates or separator is optional. This example is non-limiting, as additional separators lenses, or steel plates may be used to shield, one or more explosive layer, thereby to prevent corruption of explosive layers, prematurely. Furthermore, it must be noted that in order to augment said steel plates, as described, materials such as alumina 98, silicone carbide, etc. may be used as part of this reactive module, as well as a plurality of various materials as polymers as well as hollow structures with multitude of geometries may be used to direct, magnify, reduce, etc. blast induced forces, and physical and mechanical effects that may affect the end result of said modules, as described above. It must be noted that use of the reactive modules of the present embodiments may be executed as a stand-alone module, or in combination with other modules, either those described herein, or those known from the prior art.

It should be noted that the typical reactive armor is generally mounted slated relative to vertical orientation (although this general situation is not shown FIGS. 2 and 4).

Figure 7A:
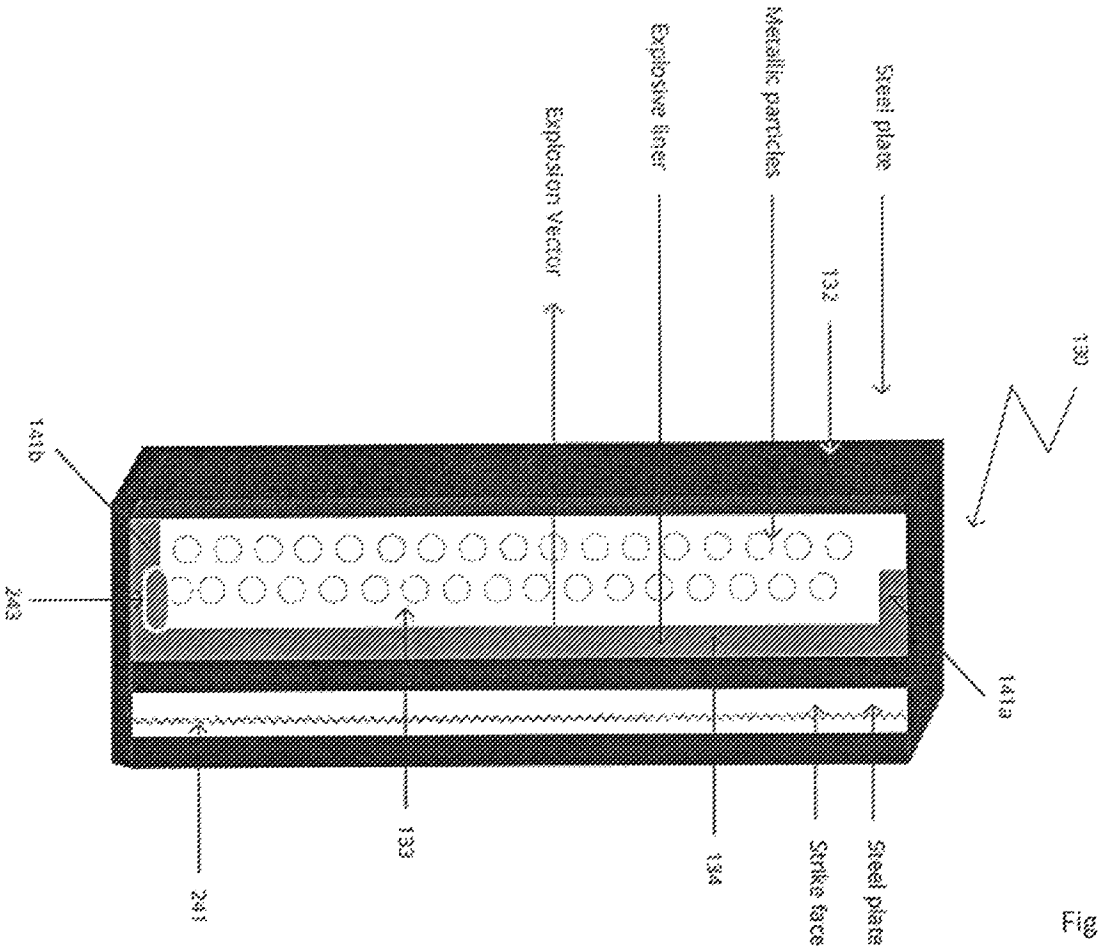
FIG. 7*a* shows in a cross-sectional form reactive armor module according to an embodiment of the invention which is provided with a triggering screen.
Figure 8A:
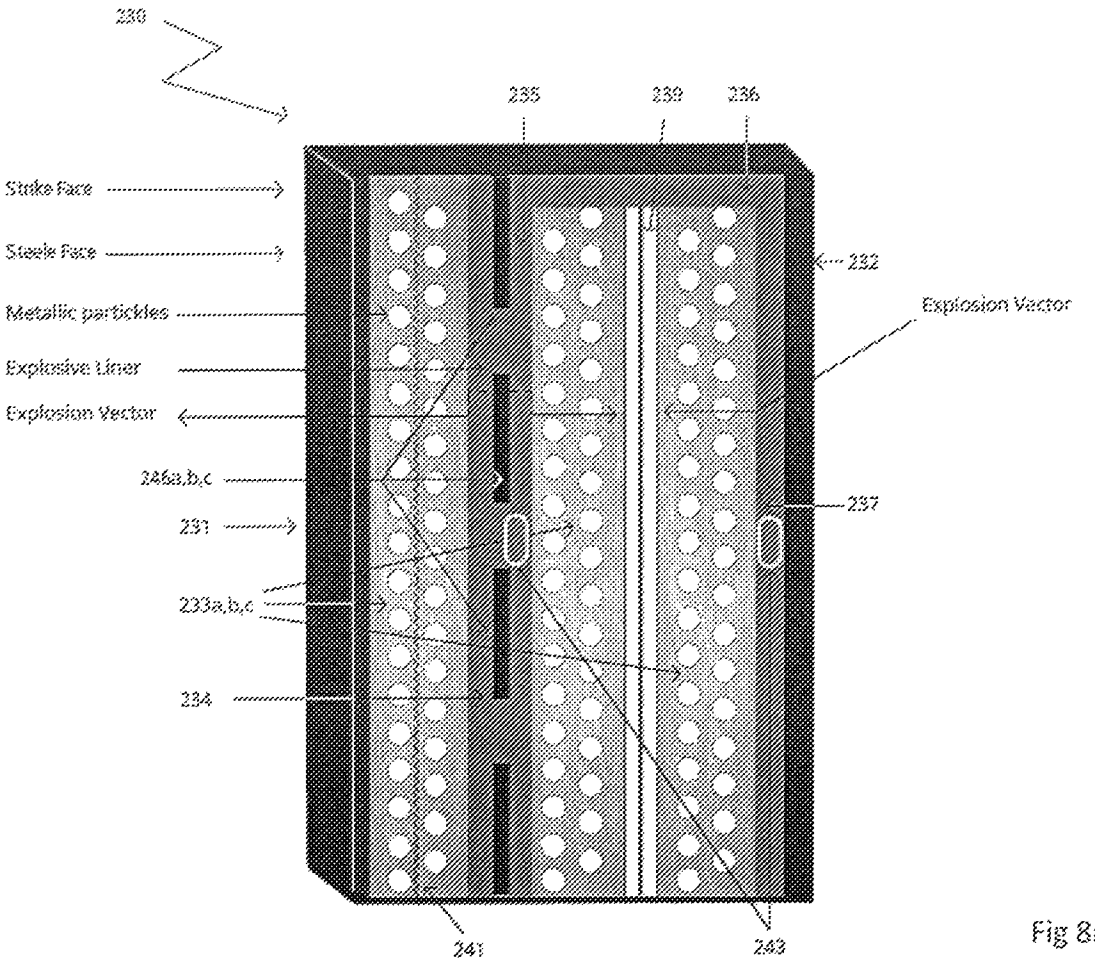
FIG. 8*a* shows in a cross-sectional form reactive armor module according to an embodiment of the invention which is provided with a triggering screen.
Figure 9:
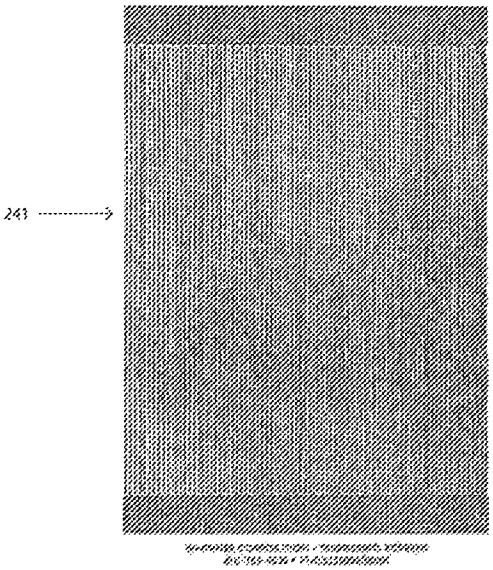
FIG. 9 shows a triggering screen which is used in an ERA of embodiments of the invention.

In still another embodiment of the present invention, a triggering screen is provided in order to enable timed initiation of the blast sequence in the ERA of the present embodiments. Triggering screens are known in the art. For example, a triggering screen model no. PT-0303500600MK is manufactured by Whithner Corporation (a US company), and is shown in FIG. 9. The triggering screen is typically used to close an electrical circuit upon its penetration. Upon penetration into the triggering screen, an electrical circuit is closed, and a detonation circuit is initiated, detonating the explosive in the charge. The latency in the blast sequence can be managed by means known in the art as to allow the blast sequence to begin, for example, 5 microseconds from the time of piercing of the triggering screen to 20 microseconds from the time of piercing. The distance of the triggering screen from the explosive layer 134 or any other part deemed as significant in said charge is a key factor in allowing the management of the blast prior to the impact by the jet. As shown in FIGS. 7*a* and 9, a triggering screen 241 is used in order to time the blast of the high explosive layer 134. According to the present embodiments, such a triggering screen 241 is mounted behind the strike face. The distance of the triggering screen 241 from the explosive layer 134 can be adjusted to determine the maximal amount of time that a blast sequence can be initiated in said charge prior to the jet impact with elements within the ERA of FIG. 7*a*. In FIG. 8*a*, the screen is positioned, for example, within the elements that compose the charge. As the jet moves through the elements that compose the charge, it triggers a blast sequence prior to the jet arrival to a designated location within the charge.

Figure 2A:
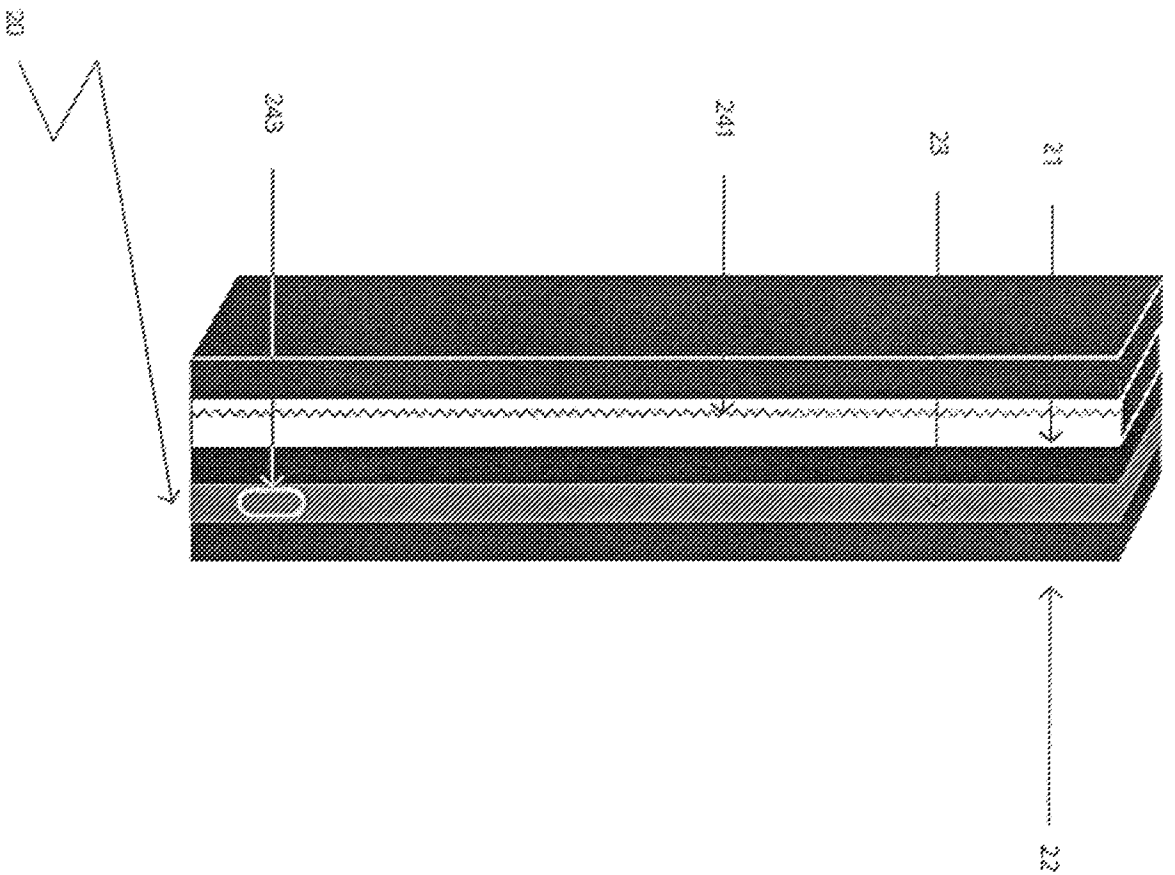
FIG. 2*a* shows in a cross-sectional form a typical reactive armor module which is provided with a triggering screen.

It should be noted that such a technique may also be used to trigger the prior art ERA module 20 (of FIG. 2) causing it to explode before the shaped charge jet impacts the front steel plate that sandwiches the high explosive. It should also be noted that utilizing said triggering mechanism using the triggering screen 241 (as shown in FIG. 2*a*), can dramatically improve the likelihood of said ERA module of FIG. 2 to defeat said jet. FIG. 2*a* shows a screen 241 which is positioned some distance before the front plate 21 of the ERA 20. The detonators are indicated in FIGS. 2*a*, 7*a*, and 8*a* as numeral 243. The blast circuits are not shown in the figures for the sake of brevity, as they are conventional.

It should also be noted that the triggering screen 241 discussed above may be augmented by other means known in the art to generate a blast sequence before the impact of the incoming jet and predetermined elements in the ERA.

Figure 10:
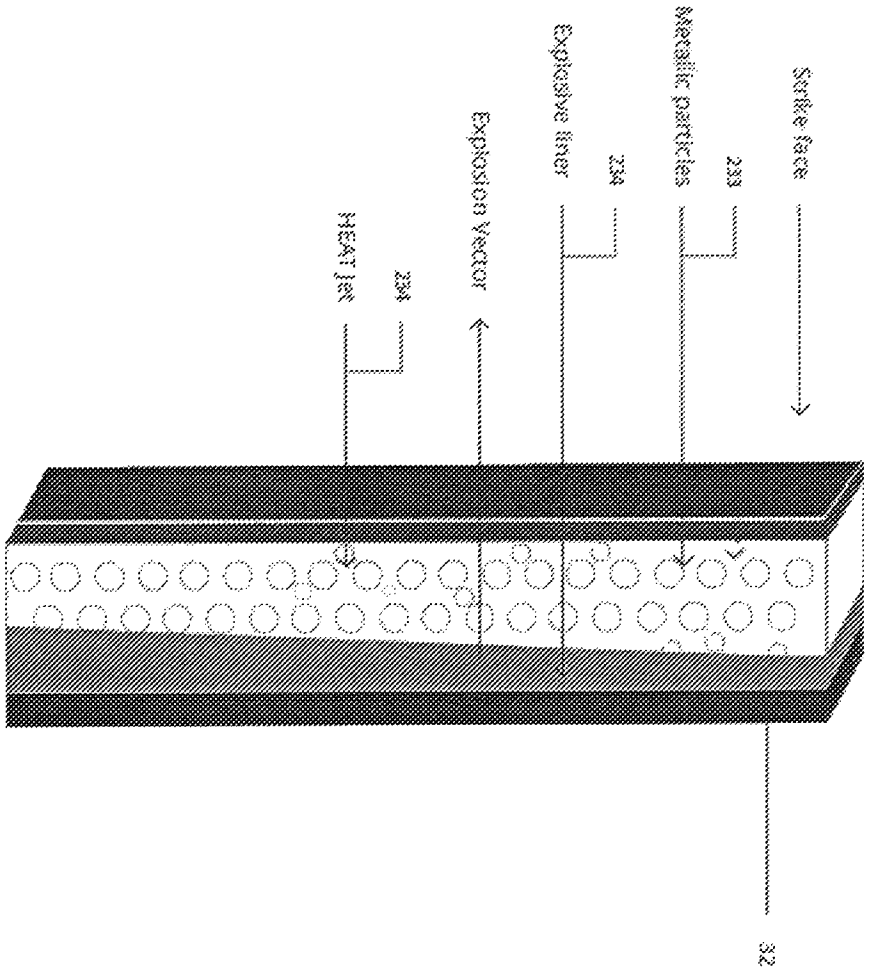
FIGS. 10-14 show still other embodiments of the invention.

FIG. 10 discloses still another embodiment of the invention. In this embodiment, the explosive layer 234 is formed and molded somewhat slanted with respect to either the horizontal or the vertical plane. In said arrangement of said reactive armor charge, upon explosion, the particles structure 233 is ejected towards the incoming HEAT jet impacting it while applying an angular directed shear force on said jet 277. In still another embodiment shown in FIG. 11, the reactive armor comprises, in addition to said slanted explosive layer 234, a triggering screen 241 for activating the detonation sequence via wiring 278, resulting in the explosion of detonator 243, as discussed above. The triggering screen may be used as means for the closure of an electric circuit in order to generate an electromagnetic or an RF signal that will be received by a suitable receiver, which will in turn initiate a blast sequence that will detonate the detonator 243.

Figure 11:
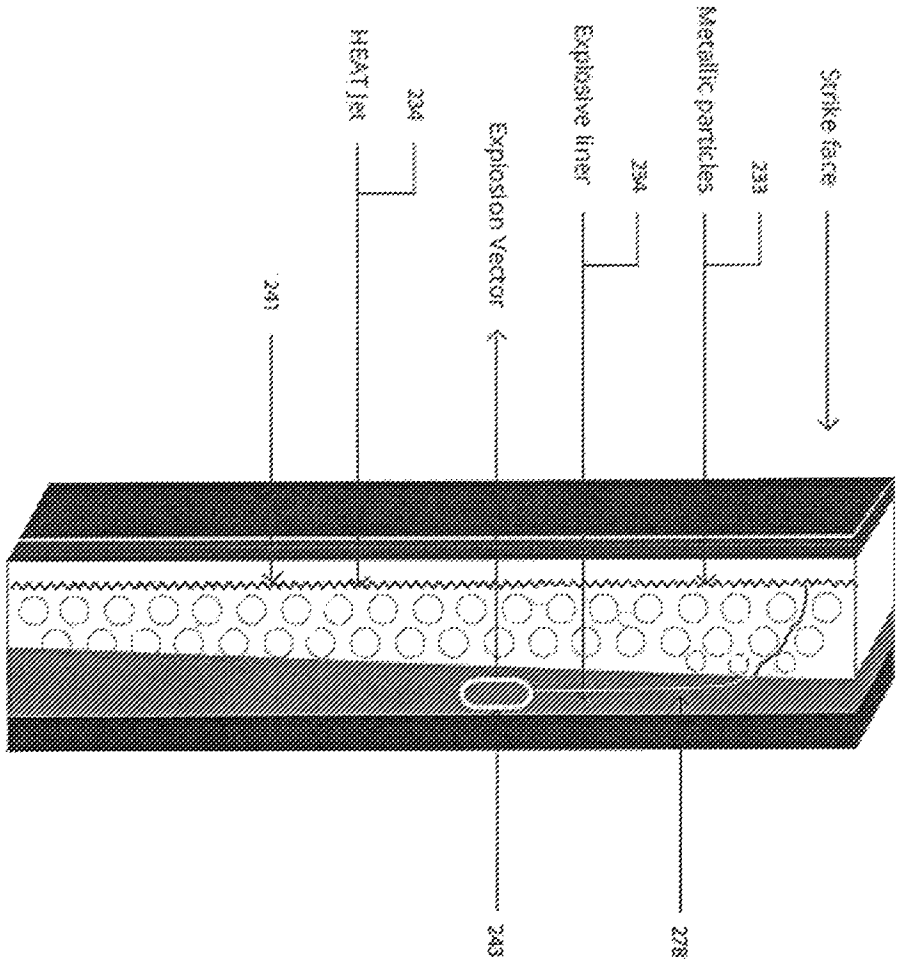

The triggering screen, as shown, for example in FIG. 11, may operate with any of the embodiments described above. The means for generating voltage to the screen, to the switching mechanism, or to the detonation element may be by the use of (a) battery; (b) capacitor; (c) an induction type circuit; (d) electromechanical element, that via the rocking motion causes a pendulum type element in a manner known in the art to move within an electromagnetic field, thereby to generate electricity, said electricity to be fed into a capacitor, battery etc.; (e) a piezoelectric element that upon pressure or impact by the HEAT jet generates electricity that might be directed into the triggering screen, as means necessary for its operation. Alternatively, the voltage which is generated by the piezoelectric element activates a switching mechanism that might release a stored energy in a capacitor or battery as means to activate said explosive sequence; (f) the use of chemicals or metals known in the art that upon contact (that is initiated by the HEAT explosion) generates electricity necessary to operate the abovementioned.

The above means (b), (e), and (f) can be used in conjunction with said triggering screen or as triggering mechanism for the reactive armoring as described in any of the abovementioned embodiments. They may also replace the triggering screen, as upon impact, they may release the necessary voltage necessary to initiate the blast sequence. Preferably, said elements (b), (e), and (f) are placed at some distance in front of the explosive charge.

Figure 12:
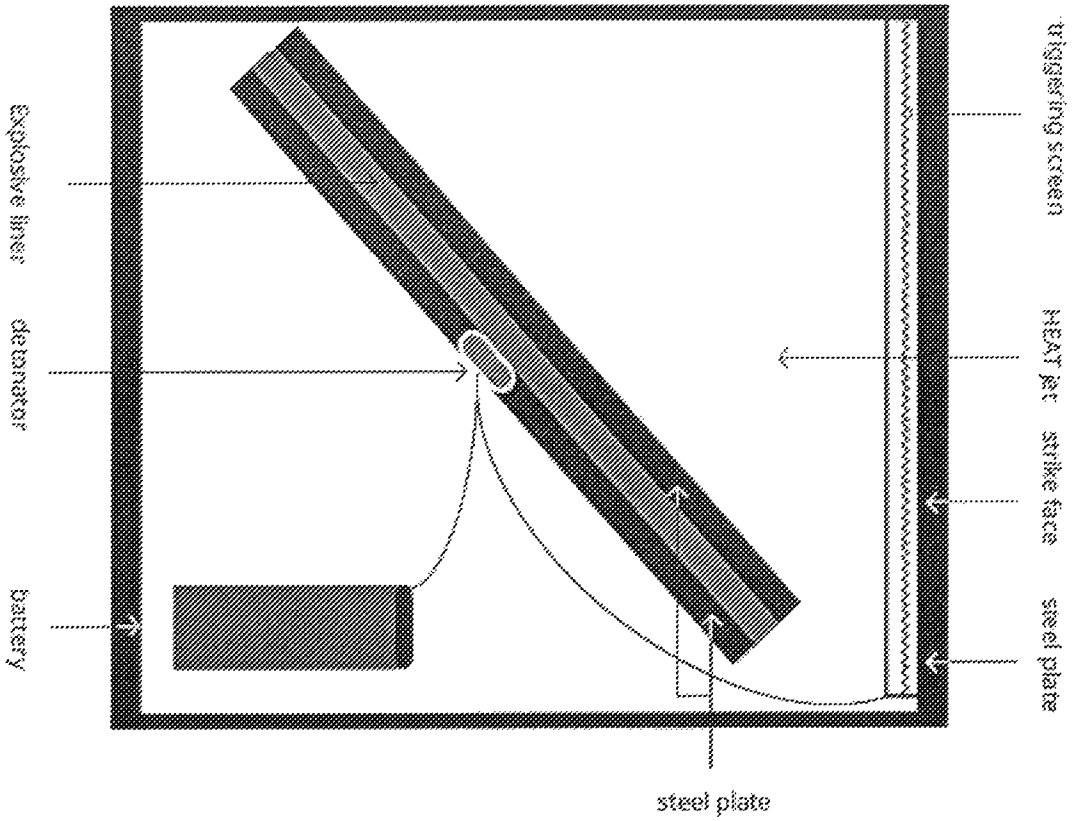

FIG. 12 illustrates a reactive armor that comprises two steel plates that sandwich high explosive. Said high explosive charge is fitted with a detonator that is activated by the triggering screen piercing as described in length above. Upon piercing the triggering screen, and prior to initiating any contact with the high explosive sandwiched in between the steel plates, a blast is initiated by the triggering screen mechanism, causing the high explosive to explode and eject one or more of the metal plates towards the incoming jet prior to its impact with said reactive armor sandwich. Said triggering screen is behind the strike face as to prevent accidental activation by elements other than the HEAT jet.

It should be noted that the strike face of all and any of the above reactive armor modules can be composed of rigid metallic elements such as steel, titanium, ballistic aluminum, and all types of metallic alloys. Furthermore, said strike face may be composed of rigid materials as alumina, boron carbide, etc. Furthermore said strike face may be composed of an assortment of polymers such as, aramid, dynema, etc. Furthermore, said strike face may be composed of compressed fibers, such as glass, carbon-fiber, etc. Each and any of the above materials may be combined or replace the strike face as described in the drawings that have been indicated in the drawings as steel.

Figure 13:
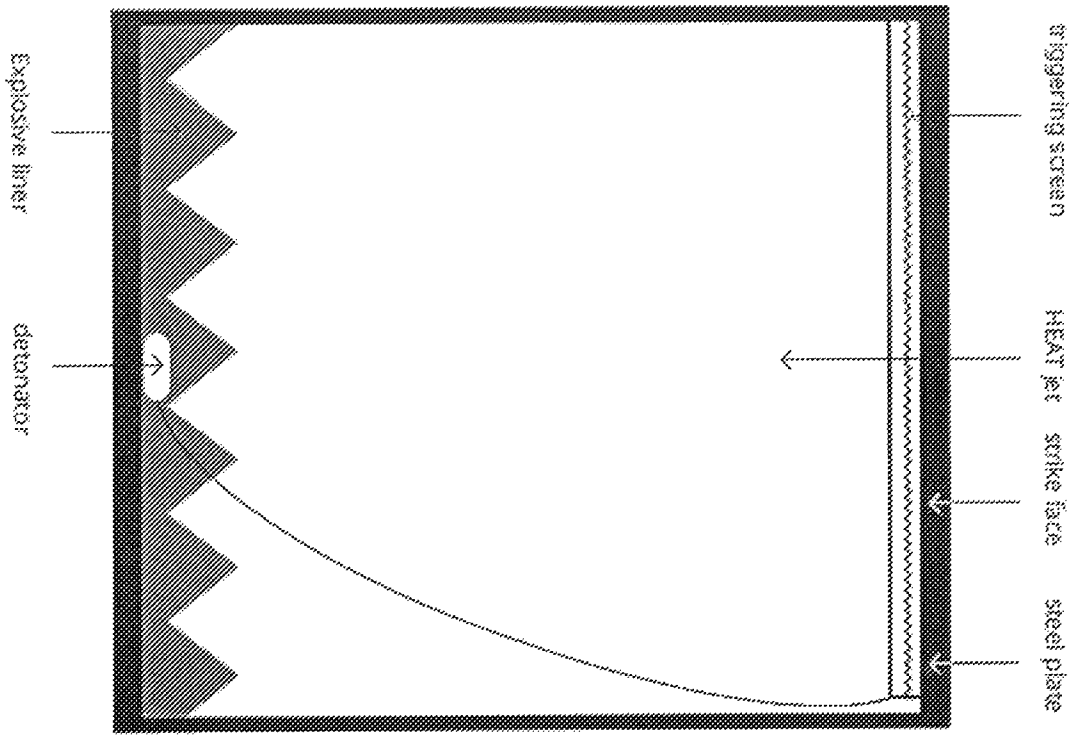

FIG. 13 illustrates still another embodiment of the invention. Explosive lenses with or without a liner (as known in the art) are used to defeat incoming HEAT jet as they are activated by the triggering screen. In order to better direct the blast wave, the shape of the lenses in cross section may be triangular (as shown in the figure), spherical, or any other shape.

Figure 14:
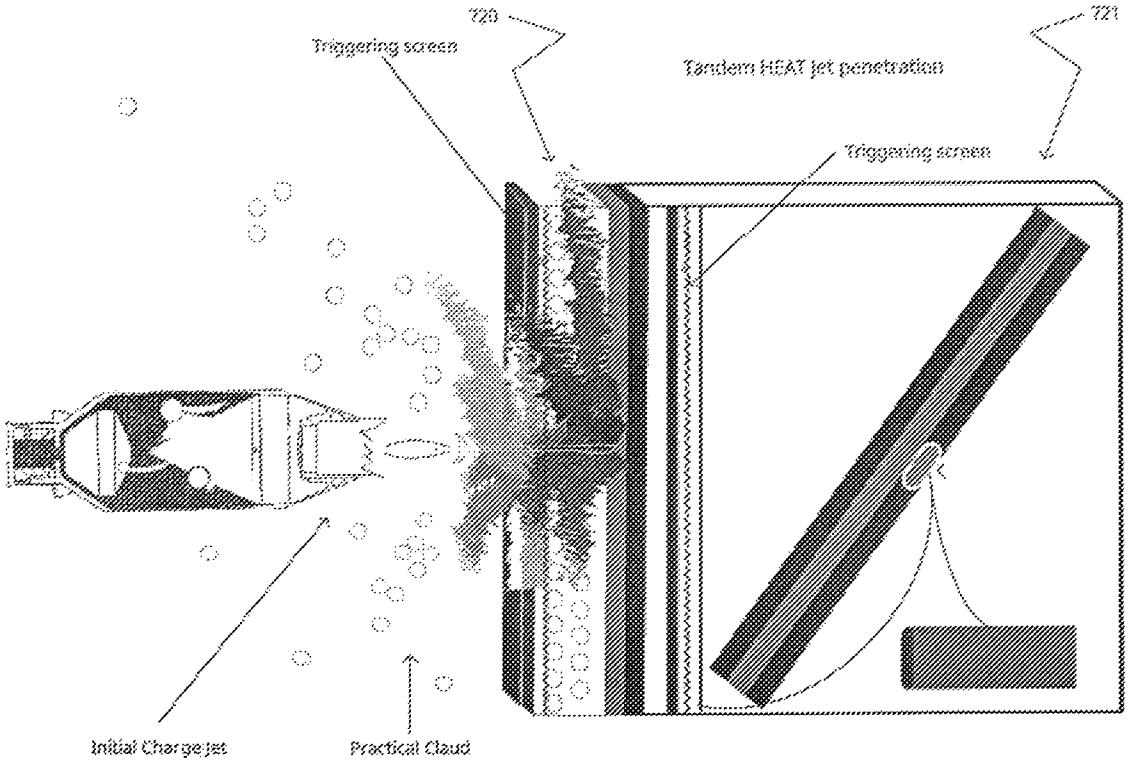

FIG. 14 illustrates a combination of a particle based explosive reactive armor and an explosive reactive armor 721 as described in FIG. 12. In each of the reactive armor modules 720 and 721 a triggering screen is provided. Any of said two triggering screens may activate the reactive modules, in a timed blast sequence.

While some embodiments of the invention have been described by way of illustration, it will be apparent that the invention can be carried into practice with many modifications, variations and adaptations, and with the use of numerous equivalents or alternative solutions that are within the scope of persons skilled in the art, without departing from the spirit of the invention or exceeding the scope of the claims.

The invention claimed is:

1. A reactive armor module having a front and a rear, the reactive armor module being for protection from a tandem warhead, the reactive armor module comprising:

A front layer of armour at said front;

a layer of particles;

an explosive layer rearward of and adjacent said layer of particles; and a rear layer of armour at said rear, the explosive layer triggerable by an incoming explosion at said front following a predetermined delay to explode into said layer of particles to eject said particles outwardly towards said front, the positioning of said explosive layer being such as to ensure that substantially all of the particles of the layer of particles are ejected outwardly towards said front, the predetermined delay being selected to disrupt a second explosion from said tandem warhead.

2. A reactive armor module according to claim 1, which further comprises a second explosive layer in between the particle layer and the front layer.

3. A reactive armor module according to claim 1, wherein the particles within the particle layer are spaced apart by spacers.

4. A reactive armour module according to claim 3, wherein said particles comprise rigid particles.

5. A reactive armour module according to claim 3, wherein said particles are shaped into one member of the group consisting of: spherical particles, cylindrical particles and a combination of shapes.

6. A reactive armor module according to claim 1, wherein said explosive layer is shaped to direct said explosion, thereby to form a directional particle cloud.

7. A reactive armour module according to claim 1, wherein said layers of armour comprise one member of the group consisting of steel, ballistic aluminum, Titanium, Aluminium, a polymer and a combination of a polymer and a rigid material.

8. A reactive armor module according to claim 1, which is provided on an armored vehicle in proximity to another reactive module.

9. A reactive armour module according to claim 3, wherein said spacers comprise energy absorbing material.

10. A reactive armour module according to claim 8, spaced from said another reactive module.

11. A reactive armour module according to claim 1, further comprising a rigid layer between said explosive layer and said particle layer.

12. A reactive armour module according to claim 1, wherein high explosive charge is mixed with the particles of said particle layer.

13. A reactive armour module according to claim 1, further comprising a casing, wherein a cross-section structure of the casing is designed to channel the energy of the explosion to achieve a desired particle cloud vector and shape.

14. A reactive armour module according to claim 11, wherein said explosive layer is shaped in a curved manner.

15. A reactive armour module according to claim 11, wherein said casing is one member of the group consisting of a shaped casing and a curved casing.

16. A reactive armour module according to claim 1, wherein a rigid material is located on a part of the explosive, thereby to create a gap between explosions of outgoing particles.

17. A reactive armour module according to claim 14, wherein said rigid layer comprises geometric elements.

18. A reactive armour module according to claim 15, wherein said geometric elements comprise a pyramid shaped element inserted in between particles of the particle layer, the pyramid having a tip, the tip being towards the explosive layer.

19. A reactive armour module according to claim 1, further comprising an additional front plate in front of the front layer of armour.

20. A reactive armour module according to claim 19, wherein said additional front plate comprises a trigger which, upon impact of an incoming HEAT jet on said trigger activates the explosive layer by one member of the group consisting of electronic signaling and a sequential blast, said sequential blast being of explosive material which is attached to said additional layer.

21. A reactive armour module according to claim 20, wherein said trigger is configured to trigger said explosive layer prior to the impact by the jet.

22. A reactive armour module according to claim 1 wherein said explosive layer is shaped to explode with multiple epicenters.

23. A reactive armour module according to claim 1, further comprising one member of the group consisting of a proximity fuse and a proximity sensor.

24. A reactive armour module according to claim 1, wherein said explosive layer is shaped to direct said explosion using the Monroe effect.

25. A reactive armour module according to claim 21, further using a blast lens.

26. A reactive armour module according to claim 1, comprising four explosive layers separating three particle layers.

27. A reactive armour module according to claim 1 comprising a triggering element and a delay element, the delay element configured to delay said explosion.

28. A reactive armour module according to claim 24, comprising a trigger, the trigger supplied with voltage by one member of the group consisting of:

(a) a battery;
(b) a capacitor;
(c) an induction type circuit;
(d) an electromechanical element, that causes a pendulum type element to move within an electromagnetic field, thereby to generate electricity, said electricity to be fed into a capacitor, battery etc.;
(e) a piezoelectric element;
(f) chemicals; and
(g) metals.

29. A reactive armour module according to claim 1, wherein a blast of said explosive layer is directed into a body of rigid particles of said particle layer, said body being arranged in a predetermined structure and the blast causing the structure to collapse into itself applying a plurality of multi directional kinetic impacts on an incoming jet, thereby to deform said incoming jet.

30. The reactive armour module of claim 29, wherein said predetermined structure comprises at least one extension along said first layer.

31. The reactive armour module of claim 30, wherein said predetermined structure comprises two extensions along said first layer and wherein said blast is triggered non-centrally between said two extensions.

32. The reactive armour module of claim 1, connected to a second reactive armour module, the second reactive armour module comprising a front layer of armour;

a back layer of armour;
an explosive layer in between said front layer and said back layer;
a triggering mechanism; and the explosive layer being triggerable by said triggering mechanism with a delay by an incoming explosion to explode into said front layer to eject said front layer to disrupt a second explosion from said warhead.

33. The reactive armour module of claim 29, wherein said explosive is shaped into a predetermined structure and wherein said predetermined structure comprises at least one extension along said first layer.

34. The reactive armour module of claim 33 wherein said predetermined structure comprises two extensions along said first layer and wherein said blast is triggered between said two extensions.

* * * * *